US006581862B1

(12) United States Patent
Young et al.

(10) Patent No.: US 6,581,862 B1
(45) Date of Patent: Jun. 24, 2003

(54) HORIZONTAL SHAFT IMPACT ROCK CRUSHER WITH BREAKER PLATE REMOVAL FEATURE

(75) Inventors: Gregory A. Young, Cedar Rapids, IA (US); Michael P. Stemper, Cedar Rapids, IA (US); Albert D. Botton, Marion, IA (US)

(73) Assignee: Cedarapids, Inc., Cedar Rapids, IA (US)

( * ) Notice: Subject to any disclaimer, the term of this patent is extended or adjusted under 35 U.S.C. 154(b) by 0 days.

(21) Appl. No.: 10/063,065

(22) Filed: Mar. 15, 2002

(51) Int. Cl.[7] ..... B02C 13/02

(52) U.S. Cl. ..... 241/189.1; 241/285.2; 241/285.3

(58) Field of Search ..... 241/189.1, 285.1, 241/258.2, 258.3

(56) References Cited

U.S. PATENT DOCUMENTS

| | | | | |
|---|---|---|---|---|
| 234,478 A | * | 11/1880 | Hubner | 241/285.3 |
| 5,529,254 A | * | 6/1996 | McIntyre et al. | 241/285.3 |
| 5,938,131 A | * | 8/1999 | Thom et al. | 241/189.1 |
| 6,070,819 A | | 6/2000 | Young et al. | |
| 6,089,481 A | | 7/2000 | Young | |
| 6,189,820 B1 | | 2/2001 | Young | |

OTHER PUBLICATIONS

The figure marked as Exhibit A shows a prior art system having a tension rod system and a short pivot shaft or pivot assembly (no date given).*

Photocopy of a photo marked as Exhibit B, which shows a prior art locking nut with a hammer bar configuration. (no date given).*

See figure marked as Exhibit C, which shows a prior art system where two secondary breaker plates share a pivot shaft. (no date given).*

Prior art system marked as Exhibit D shows a primary and secondary breaker plate sharing a pivot shaft. (no date given).*

* cited by examiner

*Primary Examiner*—John M. Husar
(74) *Attorney, Agent, or Firm*—Simmons, Perrine, Albright & Ellwood, P.L.C.

(57) ABSTRACT

A horizontal shaft impact rock crusher having breaker plates which are coupled to a shaft or pins which rest in voids along an edge of the crusher and are held in place by a retainer device, such that the breaker plates with the shaft or pins still attached can be removed from the crusher by releasing the retainer devices.

20 Claims, 3 Drawing Sheets

HORIZONTAL SHAFT IMPACT ROCK CRUSHER WITH BREAKER PLATE REMOVAL FEATURE

BACKGROUND OF INVENTION

In the past, rock crusher designers have endeavored to improve the ease of maintaining horizontal shaft impact rock crushers. While many improvements have been made to reduce the expense associated with repair and maintenance of such crushers, removal of all of the breaker plates on such crushers remains a non-trivial task. Most crushers usually have two breaker plates. A primary breaker plate is disposed nearest the feed opening and nearest the top of the crusher. These crushers typically have a secondary or rear breaker plate, which is generally located lower in the crusher and more toward the rear of the crusher. Some attempt has been made to reduce the removal time for the primary breaker plates. One example is the crusher shown in U.S. Pat. No. 6,089,481 entitled APPARATUS FOR RELIEVING THE LOAD ON ADJUSTING RODS OF A CRUSHER, issued to Gregory A. Young. This patent shows a primary breaker plate pivot shaft disposed near a front edge of the tiltable portion of the crusher. When the crusher housing is tilted for repair, the pivot shaft of the primary breaker plate can be lifted out of the crusher while the breaker plate is still attached. Another example of an attempt to reduce the removal time for primary breaker plates (or curtains, as they are sometime called) has been to hang one or more of them on a single cradle. However, it is typical that when a repair is needed on any of the breaker plates, the breaker plate pivot shaft, which is typically directly coupled to each of the breaker plates and typically extends wall-to-wall across the crusher, (a directly coupled trans-crusher pivot shaft) is either driven or pulled from the crusher, and then the breaker plates may be removed.

While this approach of driving or pulling the pivot shaft prior to breaker plate removal has been used extensively in the past, it does have some drawbacks. First of all, depending upon the condition of the breaker plate pivot shaft (which can be bent), or any distortion of the breaker plate itself, or the crusher frame, this can involve significant effort and can leave the crusher out of service for an extended time period.

Consequently, there exists a need for improved methods and systems for rapidly removing and replacing all of the breaker plates in horizontal shaft impact rock crushers in an efficient manner.

SUMMARY OF INVENTION

It is an object of the present invention to provide a system and method for repairing and maintaining a horizontal shaft impact rock crusher in an efficient manner.

It is a feature of the present invention to utilize directly coupled trans-crusher pivot shafts mounted in slots with movable structures for permitting rapid access to the shafts and thereby permitting rapid removal of all breaker plates, with the breaker plate pivot shaft remaining therein.

It is another feature of the present invention to utilize short pivot shafts or pins mounted in slots with movable structures for permitting rapid access to the pins or shafts and thereby permitting rapid removal of all breaker plates, with the breaker plate pin or shaft remaining coupled thereto.

It is an advantage of the present invention to achieve improved efficiency in replacing the entire complement of breaker plates in horizontal shaft impact rock crushers.

The present invention is an apparatus and method for repairing and maintaining horizontal shaft impact crushers which are designed to satisfy the aforementioned needs, provide the previously stated objects, include the above-listed features, and achieve the already articulated advantages. The present invention is carried out in a "wasted time-less" manner in a sense that the time consumed with separating (driving or pulling apart) a breaker plate and its associated pivot shaft prior to removal of a breaker plate from a crusher, has been eliminated.

Accordingly, the present invention is a system and method including a horizontal shaft impact crusher having a movable breaker pivot shaft slot cover or retaining member which permits access to and removal of a pivot shaft from a void near a periphery of the crusher while the pivot shaft remains directly coupled to the breaker plate.

BRIEF DESCRIPTION OF DRAWINGS

The invention may be more fully understood by reading the following description of the preferred embodiments of the invention, in conjunction with the appended drawings wherein.

DETAILED DESCRIPTION

Figure 1:
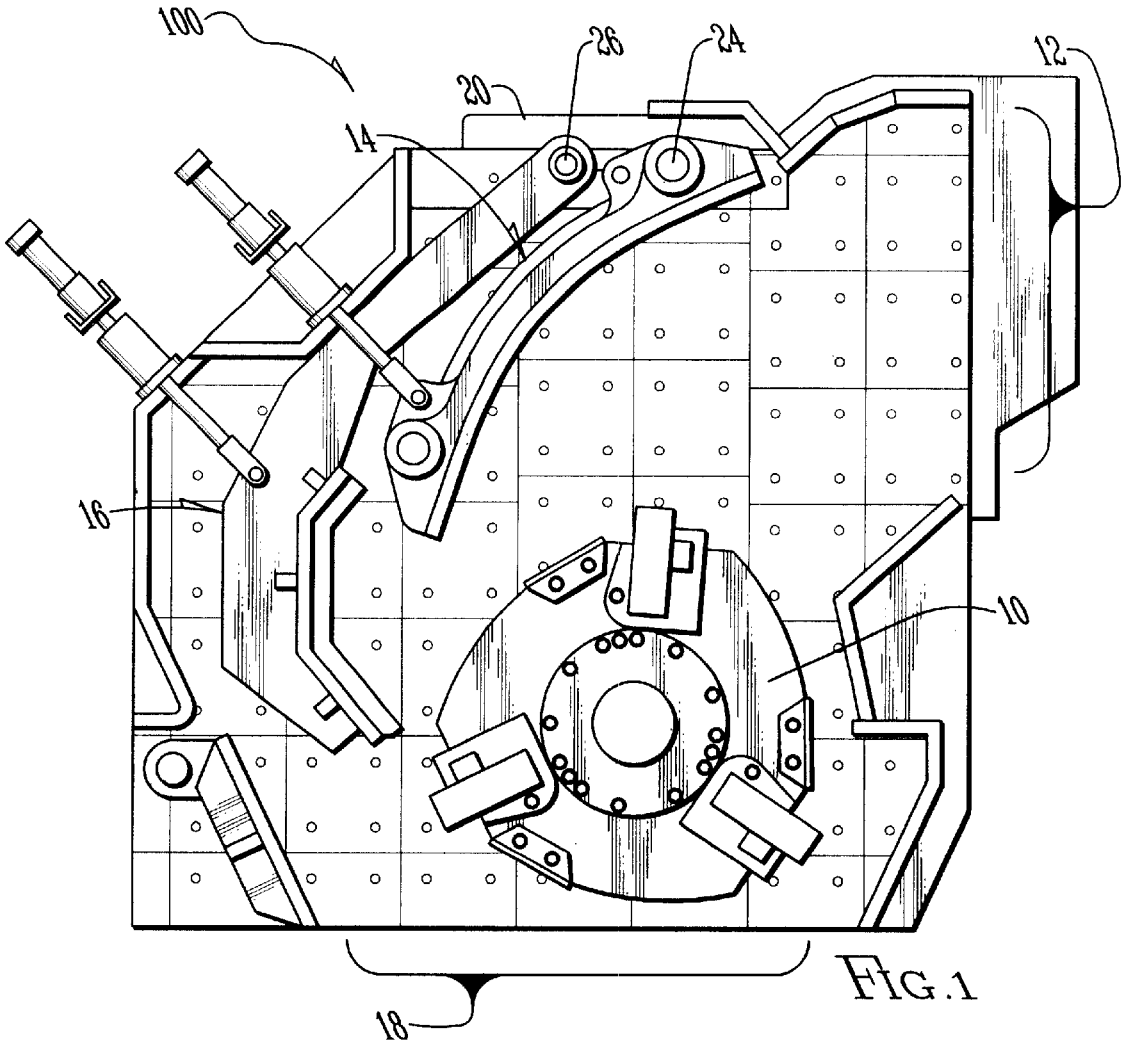
FIG. 1 is a schematic sectional view of a horizontal shaft impact crusher of the present invention, employing a removable pivot shaft slot cover.

Now referring to the drawings wherein like numerals refer to like matter throughout, and more specifically referring to FIG. 1, there is shown a system of the present invention generally designated 100, including a horizontal shaft rotor 10, a feed opening 12, a primary breaker plate 14, a secondary breaker plate 16 and a discharge opening 18. Primary breaker plate 14 is coupled to the crusher 100 by primary breaker plate pivot shaft 24. Primary breaker plate pivot shaft 24 is preferably a trans-crusher directly coupled pivot shaft which extends from wall-to-wall of the crusher 100 and extends directly through a portion of primary breaker plate 14. Similarly, secondary breaker plate pivot shaft 26 is preferably a trans-crusher directly coupled pivot shaft which extends from wall-to-wall of the crusher 100 and extends directly through a portion of secondary breaker plate 16. Primary breaker plate pivot shaft 24 and secondary breaker plate pivot shaft 26 are preferably disposed in a pivot shaft-mounting slot 30 (FIG. 3) which are covered by removable top shaft slot cover 20. It should be understood that primary breaker plate pivot shaft 24 or secondary breaker plate pivot shaft 26 as shown in FIG. 1 could be trans-crusher shafts or short shafts or pins which merely extend from the respective breaker plate to the housing of the crusher 100.

Figure 2:
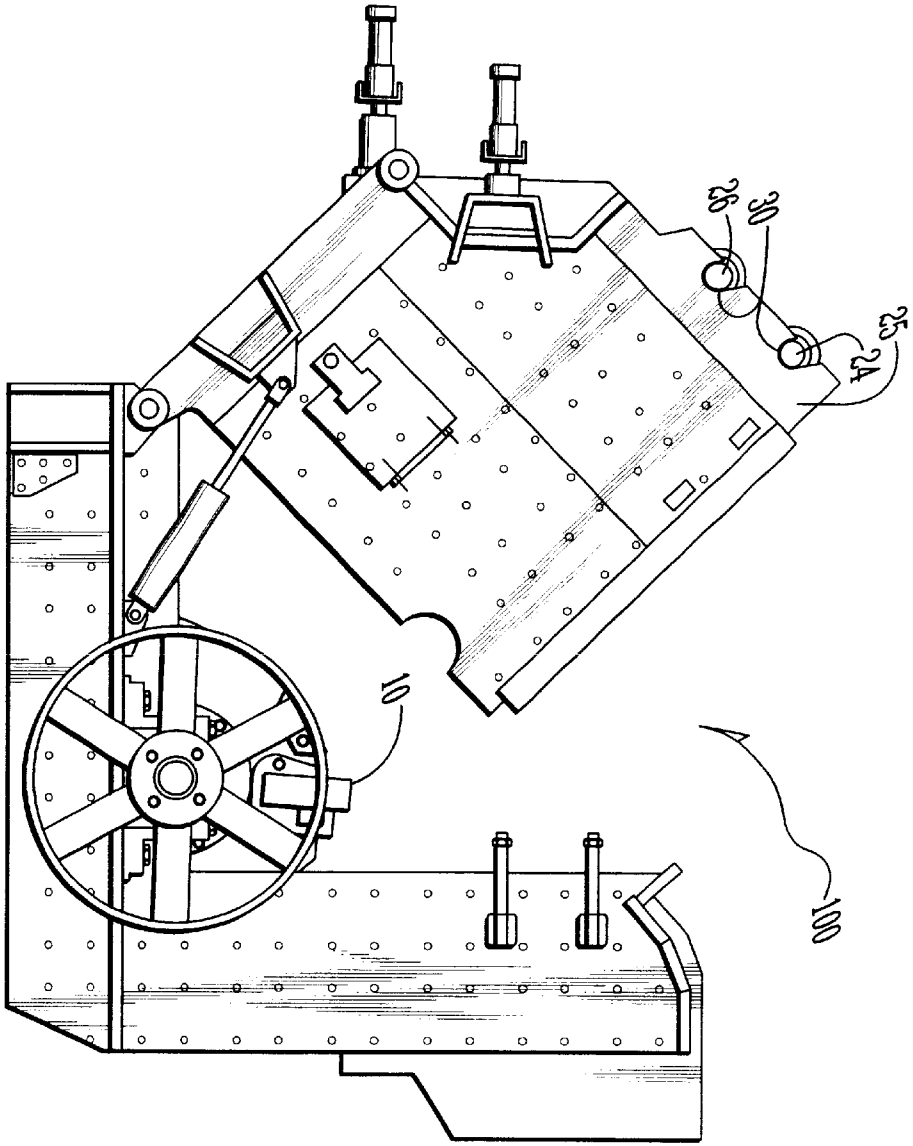
FIG. 2 is an elevational view of a horizontal shaft impact crusher of the present invention, in which the housing has been tilted and where the removable pivot shaft slot cover has been removed, exposing the pivot shaft slots.

A more detailed understanding of the present invention can be achieved by now referring to FIG. 2, which shows the crusher 100 after the housing has been tilted for maintenance and the removable top shaft slot cover 20 has been removed. Additionally, the present invention would preferably include pivot shaft end caps disposed at the ends of each pivot shaft. These end caps (not shown) could be any structure designed to keep primary breaker plate pivot shaft 24 and secondary breaker plate pivot shaft 26 from sliding out of the pivot shaft-mounting slot 30. The end caps could be held in place with clamps, pins, bolts, rivets, welding or any suitable structure or process. Primary breaker plate pivot shaft 24 and secondary breaker plate pivot shaft 26 are each shown in a pivot shaft-mounting slot 30 in a reinforcing plate 25 on the crusher 100.

Figure 3:
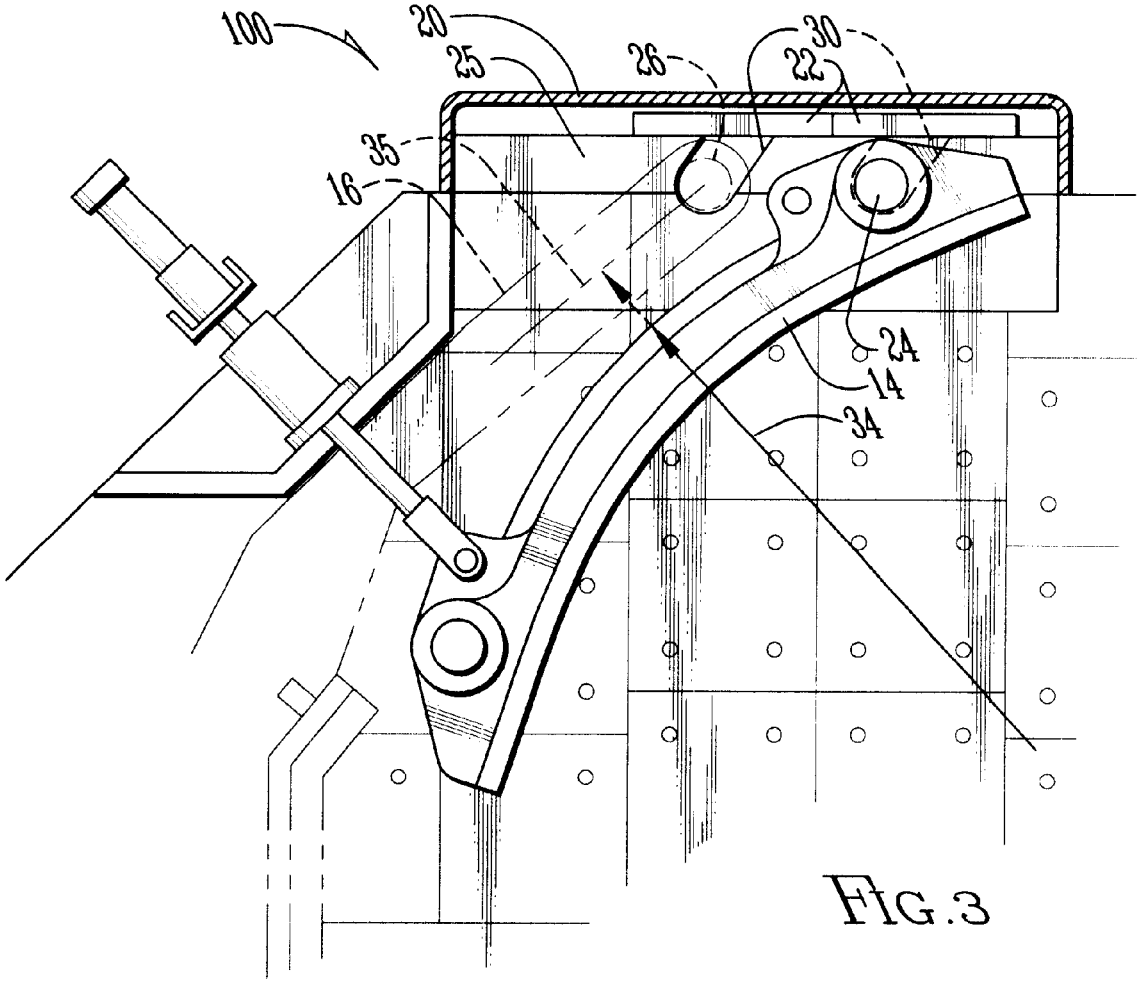
FIG. 3 is an enlarged elevational view of a portion of the top of the crusher of FIG. 2, showing the configuration of pivot shaft slots in more detail.

An even more detailed understanding of the present invention may be achieved by now referring to FIG. 3, which shows an enlarged view of a portion of the top side of the crusher 100 with one of the pivot shaft-mounting slots 30 empty and the other pivot shaft mounting slot 30 occupied by primary breaker plate pivot shaft 24. The shape of a pivot shaft-mounting slot 30 is shown as being slanted with respect to the top of the crusher 100. A force vector 34 is shown which represents the primary direction of impact forces upon primary breaker plate 14 during operation. The slanted shape of pivot shaft-mounting slot 30 helps to retain the primary breaker plate pivot shaft 24 and secondary breaker plate pivot shaft 26 in place during operation when the primary breaker plate 14 and secondary breaker plate 16 are experiencing forces, such as shown by force vector 34. The slanted shape of pivot shaft-mounting slot 30 also permits much of the impact forces during operation of the crusher 100 to be absorbed by crusher housing and reinforcing plate 25 in lieu of additional operational impact forces being absorbed by retainer bars 22, removable top shaft slot cover 20, the pivot shaft end caps or any other structure designed to keep the primary breaker plate pivot shaft 24 and the secondary breaker plate pivot shaft 26 in place in the pivot shaft-mounting slot 30. Pivot shaft-mounting slot 30 is shown having a depth axis 35 which is substantially orthogonal to force vector 34. Retainer bars 22 are designed to be removable and when in place, prevent the pivot shaft 26 from exiting the slot 30.

In operation, the apparatus and method of the present invention as described in FIGS. 1–3, could function as follows:

A rock crusher 100 is provided with a removable primary breaker plate which can be removed without driving or pulling the shaft from the primary breaker plate.

The crusher 100 is also provided with a secondary breaker plate which can be removed without driving or pulling the shaft from the secondary breaker plate.

The primary breaker plate is removed. (Note: this could be using the same method as described below or with a known prior art method using cradles.)

A mechanism holding the secondary pivot shaft for the secondary breaker plate is manipulated to permit removal of the secondary pivot shaft from a void.

The secondary breaker plate is removed, with the secondary breaker plate pivot shaft still directly coupled thereto.

Throughout this description, reference is made to secondary breaker plates, because it is believed that the beneficial aspects of the present invention would be most readily apparent when used in connection with crushers using two breaker plates; however, it should be understood that the present invention is not intended to be limited to merely dual breaker plate designs and should be hereby construed to include other multiple breaker plate crushers as well. In such crushers, all non-primary breaker plates may be viewed as secondary and may be able to employ the innovative aspects of the present invention. In all designs, it should be understood that if two or more breaker plates are used in the crusher, their associate pivot shafts need not necessarily be located in close proximity to each other. As is shown in FIGS. 1–3, other locations could be used especially for additional breaker plates beyond the second breaker plate.

Additionally, throughout this description, the pivot shafts are described as trans-crusher wall-to-wall pivot shafts where the breaker plates pivot about the pivot shaft. It should be understood that the pivot shafts herein need not be trans-crushers; i.e., they need not extend across the crusher. Each breaker plate could be supported by two or more pins, at least on each side acting as pivot shafts. It also should be understood that the breaker plate may preferably pivot with respect to said pivot shaft or pins; they need not. The breaker plates could be firmly fixed to the pivot shafts or pins, and the pivot shafts or pins could pivot with respect to the crusher housing.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A rock crusher comprising:

a housing;

a rotor, disposed at least in part within said housing, said rotor having a substantially horizontal drive shaft;

said rotor configured for impacting material introduced into said housing;

a first breaker plate disposed substantially above said rotor, said first breaker plate configured for decelerating objects impacted by said rotor;

a second breaker plate, disposed substantially below and behind said first breaker plate and substantially behind said rotor;

said second breaker plate configured for decelerating objects impacted by said rotor;

a pivot shaft coupled to said second breaker plate;

said housing having a void therein along a periphery of said housing, which void is configured to receive said pivot shaft therein and further configured to, at least partially, retain said pivot shaft while objects impact said second breaker plate as said rotor turns; and, said void is further configured such that said pivot shaft can be completely removed from said crusher while said pivot shaft remains coupled to said second breaker plate.

2. A crusher of claim 1 further comprising a retainer bar and a removable top shaft slot cover, which are detachable from said housing to expose a portion of said pivot shaft.

3. A crusher of claim 1 wherein said void is a slot in a reinforcing plate along an edge of said housing.

4. A crusher of claim 3 wherein said slot is angled rearward of a vertical line extending down from a top portion of said slot.

5. A crusher of claim 4 wherein said slot has a depth axis which is not substantially parallel to a force vector which is representative of average impact forces on said second breaker plate.

6. A crusher of claim 5 wherein said depth axis is substantially orthogonal to said force vector.

7. A crusher of claim 6 wherein said housing further having pivot shaft end caps which, at least partially, retain said pivot shaft in said void.

8. A crusher of claim 1 wherein said housing further having pivot shaft end caps which, at least partially, retain said pivot shaft in said void.

9. A crusher of claim 1 wherein said pivot shaft is pivotally coupled to said second breaker plate.

10. A crusher of claim 1 wherein said pivot shaft pivots with respect to said housing and is fixed with respect to said second breaker plate.

11. A crusher of claim 1 wherein said first breaker plate is coupled to a first breaker plate pivot shaft which is disposed in a first breaker plate pivot shaft slot disposed adjacent to said void.

12. A crusher of claim 1 wherein said pivot shaft is a directly coupled trans-crusher pivot shaft.

13. A crusher of claim 1 wherein said pivot shaft does not extend across said crusher.

14. A crusher of claim 1 wherein said pivot shaft is a first pivot pin disposed on a first side of said crusher, and said crusher further comprises a second pivot pin disposed on an opposing second side of said crusher.

15. A crusher of claim 14 wherein said second breaker plate is fixed with respect to said first pivot pin and said second pivot pin, and said first pivot pin and said second pivot pin pivot with respect to said housing.

16. A crusher comprising:

a housing;

a rotor, disposed at least in part within said housing, said rotor having a substantially horizontal drive shaft;

said rotor configured for impacting material introduced into said housing;

a plurality of breaker plates disposed substantially within said housing;

each of said plurality of breaker plates having coupled thereto, at least one of a plurality of shafts which extends at least between at least one side of one of said plurality of breaker plates and said housing; and, a plurality of means for selectively retaining each of plurality of shafts to said housing such that when each of said plurality of means for selectively retaining is manipulated, each of said plurality of shafts is at least partially released from retention and is freer to be removed from said housing while having a breaker plate remaining coupled thereto.

17. A crusher of claim 12 wherein said plurality of means for selectively retaining comprises:

a plurality of voids for receiving therein said plurality of shafts; and, at least one selectively movable shaft cover which inhibits movement of at least one of said plurality of shafts from at least one of said plurality of voids, when said movable cover is deployed for retention of at least one of said plurality of shafts and releases at least one of said plurality of shafts when deployed for permitting access to at least one of said plurality of shafts.

18. A crusher of claim 13 wherein said plurality of voids are a plurality of slanted slots along a periphery of said housing, and said selectively movable shaft cover is a removable top shaft slot cover disposed over at least one of said plurality of slanted slots.

19. A crusher of claim 12 wherein said plurality of means for selectively retaining comprises a plurality of clamps.

20. A rock crusher comprising:

a housing;

a rotor, disposed at least in part within said housing, said rotor having a substantially horizontal drive shaft;

said rotor configured for impacting material introduced into said housing;

a first breaker plate disposed substantially above said rotor, said first breaker plate configured for decelerating objects impacted by said rotor;

a second breaker plate, disposed substantially below and behind said first breaker plate and substantially behind said rotor;

said second breaker plate configured for decelerating objects impacted by said rotor;

at least one pivot shaft fixed to said second breaker plate, said housing having a plurality of voids therein at least one of said plurality of voids being disposed along each of opposing sides of a periphery of said housing, each of said plurality of voids is configured to receive a shaft therein and further configured to, at least partially, retain a shaft while objects impact said second breaker plate as said rotor turns;

each of said plurality of voids is further configured such that a shaft can be completely removed from said crusher while said pivot shaft remains coupled to said second breaker plate;

a retainer bar which is detachable from said housing to expose a portion of said pivot shaft;

a removable top shaft slot cover, which is detachable from said housing to expose a portion of said pivot shaft;

wherein each of said plurality of voids is a slot in a reinforcing plate along an edge of said housing;

wherein said slot is angled rearward of a vertical line extending down from a top portion of said slot;

wherein said slot has a depth axis which is not substantially parallel to a force vector which is representative of average impact forces on said second breaker plate; and, wherein said housing further having a pivot shaft end cap which, at least partially, retains said pivot shaft in said slot.

* * * * *

UNITED STATES PATENT AND TRADEMARK OFFICE

CERTIFICATE OF CORRECTION

PATENT NO. : 6,581,862 B1
DATED : June 24, 2003
INVENTOR(S) : Gregory A. Young et al.

It is certified that error appears in the above-identified patent and that said Letters Patent is hereby corrected as shown below:

Column 5,
Line 45, please delete "12" and insert therefor -- 16 --.

Column 6,
Line 3, please delete "13" and insert therefor -- 17 --.
Line 8, please delete "12" and insert therefor -- 16 --.

Signed and Sealed this

Fourteenth Day of October, 2003

JAMES E. ROGAN
*Director of the United States Patent and Trademark Office*